US008203258B2

(12) United States Patent
Kameda et al.

(10) Patent No.: US 8,203,258 B2
(45) Date of Patent: Jun. 19, 2012

(54) SPARK PLUG FOR LOW TEMPERATURE ENVIRONMENT

(75) Inventors: Hiroyuki Kameda, Aichi (JP); Tomoaki Kato, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/998,534

(22) PCT Filed: Nov. 2, 2009

(86) PCT No.: PCT/JP2009/005810

§ 371 (c)(1),
(2), (4) Date: Apr. 29, 2011

(87) PCT Pub. No.: WO2010/052880

PCT Pub. Date: May 14, 2010

(65) Prior Publication Data

US 2011/0215702 A1 Sep. 8, 2011

(30) Foreign Application Priority Data

Nov. 5, 2008 (JP) ..... 2008-284705

(51) Int. Cl.
*H01T 13/20* (2006.01)

(52) U.S. Cl. ..... 313/141; 313/140

(58) Field of Classification Search ..... 123/169 R, 123/169 EL, 32, 41, 310; 313/118–145; 445/7

See application file for complete search history.

(56) References Cited

U.S. PATENT DOCUMENTS

| | | | | |
|---|---|---|---|---|
| 2,650,583 | A * | 9/1953 | Devaux | 313/140 |
| 3,313,972 | A * | 4/1967 | Beesch | 313/130 |
| 4,700,103 | A | 10/1987 | Yamaguchi et al. | 313/141 |
| 5,497,045 | A * | 3/1996 | Matsutani et al. | 313/141 |
| 6,064,143 | A | 5/2000 | Kagawa | 313/141 |
| 6,628,050 | B1 * | 9/2003 | Kameda et al. | 313/143 |
| 7,812,509 | B2 * | 10/2010 | Tanaka et al. | 313/141 |
| 2007/0216278 | A1 | 9/2007 | Yoshida | 313/141 |

FOREIGN PATENT DOCUMENTS

| | | |
|---|---|---|
| JP | 61-45583 | 3/1986 |
| JP | 8222350 | 8/1996 |
| JP | 9213449 | 8/1997 |
| JP | 10-189212 | 7/1998 |
| JP | 2004-022450 | 1/2004 |
| JP | 2007-250258 | 9/2007 |

OTHER PUBLICATIONS

Form PCT/ISA/210—Int'l Search Report (from corresponding Int'l Patent App. No. PCT/JP2009/005810—English version only); 2 pages.

* cited by examiner

*Primary Examiner* — Anne Hines
*Assistant Examiner* — Jose M Diaz
(74) *Attorney, Agent, or Firm* — Kusner & Jaffe

(57) ABSTRACT

A spark plug having an electrode, an insulator, a metallic shell, a main ground electrode, and at least two auxiliary ground electrodes.

6 Claims, 8 Drawing Sheets

SPARK PLUG FOR LOW TEMPERATURE ENVIRONMENT

FIELD OF THE INVENTION

The present invention relates to a spark plug, and more particularly to a spark plug for use in, for example, an internal combustion engine.

BACKGROUND OF THE INVENTION

In general, a spark plug used for an internal combustion engine such as an automotive engine includes a center electrode disposed in a combustion chamber of the internal combustion engine, and a ground electrode disposed to face the center electrode via a spark discharge gap. Such a spark plug produces spark discharge at the spark discharge gap within the combustion chamber of the internal combustion engine to thereby burn an air-fuel mixture charged into the combustion chamber.

When an internal combustion engine to which such a spark plug is attached is started in a low temperature environment, or when the internal combustion engine to which such a spark plug is attached is of a direct injection type, fuel that is injected into a combustion chamber may hit directly against an ignition portion of the spark plug, whereby the fuel may adhere to and remain between the center electrode and the ground electrode in the form of a droplet, to thereby form a so-called "fuel bridge." If a fuel bridge is formed between the center electrode and the ground electrode, spark discharge fails to be properly generated between the center electrode and the ground electrode, and the ability of the internal combustion engine to start is reduced greatly.

In order to solve such a problem caused by a fuel bridge, there has been proposed a spark plug having a larger spark discharge gap between a center electrode and a ground electrode thereof. For example, Patent Document 1, Japanese Patent Application Laid Open (kokai) No. 2007-250258, describes a spark plug for an internal combustion engine which comprises a mounting bracket having a mounting screw portion provided on the outer circumference thereof. An insulator is held inside the mounting bracket, and a center electrode is held in an insulator hole of the insulator. A ground electrode forms a spark discharge gap in cooperation with the center electrode. As viewed from the front end side of the spark plug, the area S1 of a portion of the insulator hole located outside the outer edge of the ground electrode and the area S2 of the entire insulator hole have a relation $S1/S2 \leqq 0.3$. In addition, the projection amount L of the center electrode from a front end portion of the insulator is equal to or less than 0.6 mm; and the minimum and maximum values Hmin and Hmax of the distance between a flat surface formed on the insulator front end portion and a flat surface formed on the ground electrode and facing the former flat surface have a relation $Hmax/Hmin \leqq 1.3$. Still further, the thickness T of the insulator between the insulator hole and the outer circumferential surface of the insulator is equal to or less than 0.7 mm; and the diameter d of the front end portion of the center electrode is equal to or less than 0.6 mm.

Incidentally, when the spark discharge gap of a spark plug is enlarged, the discharge voltage at which spark discharge occurs tends to increase. Therefore, the capacity of a coil power source imposes a certain limit on expansion of the spark discharge gap.

In the case where a spark plug is of a so-called "parallel type" in which a distal end portion of the ground electrode is disposed on the axis of the center electrode to face the end surface of the center electrode as in a spark plug described in Patent Document 1, Japanese Patent Application Laid Open (kokai) No. 2007-250258, even when the spark discharge gap is enlarged within a range in which the above-described characteristic of the spark plug can be maintained, a fuel bridge is apt to be formed and the formed bridge is apt to be maintained, because the spark plug has a bent ground electrode. Therefore, the parallel-type spark plug may fail to completely solve the above-mentioned problem of degraded startability.

Meanwhile, when starting and stopping of an internal combustion engine is repeated or short-time operation of the engine is repeated in a low temperature environment, a phenomenon in which carbon adheres to the surface of the insulator of a spark plug (hereinafter may be referred to as "sooting up") is likely to occur, which may lower insulating performance and igniting performance. Accordingly, an internal combustion engine, in particular, an internal combustion engine used in a low temperature environment is desired to have a high sooting-up prevention performance.

SUMMARY OF THE INVENTION

An object of the present invention is to provide a spark plug which can improve startability and sooting-up prevention performance of an internal combustion engine in a low temperature environment.

The present invention, which serves as a means for solving the above-described problem, is a spark plug comprising a rod-like center electrode extending in a direction of an axis. An approximately cylindrical tubular insulator is provided on the periphery of the center electrode, and an approximately tubular metallic shell is provided on the periphery of the insulator. A main ground electrode and at least two auxiliary ground electrodes having respective proximal end portions are joined to a front end portion of the metallic shell, wherein (i) the main ground electrode is disposed so that its distal end portion faces a side surface of a front end portion of the center electrode and forms a main spark discharge gap between the distal end portion and the front end portion of the center electrode;

(ii) each of the auxiliary ground electrodes is disposed so that a portion of its distal end portion end surface faces an outer circumferential surface of a front end portion of the insulator; and (iii) a total area S ($mm^2$) satisfies an expression $S/Av<1.3$, which represents a relation between the total area S (mm) and an average gap distance Av (mm) of the main spark discharge gap, where the total area S is the sum of a projection area C ($mm^2$) of a portion of the distal end portion of the main ground electrode which overlaps with a projected region of the front end portion of the center electrode when the distal end portion of the main ground electrode and the front end portion of the center electrode are projected along a radial direction of the center electrode, and a projection area D ($mm^2$) of a portion of the front end portion of the center electrode which overlaps with a projected region of the distal end portion of the main ground electrode when the distal end portion of the main ground electrode and the front end portion of the center electrode are projected along the radial direction of the center electrode.

Preferred embodiments of the present invention are as follows.

(1) The total area S ($mm^2$) satisfies an expression $0.25 \leqq S/Av \leqq 1$, which represents a relation between the total area S and the average gap distance Av (mm).

(2) As viewed on a plane radially extending from an axis of the center electrode, a distance between an end edge of a distal end portion of the main ground electrode and a circumferential edge of the center electrode, as measured along an imaginary line connecting the axis of the center electrode and an axis of the main ground electrode, varies in a direction perpendicular to the imaginary line.

(3) The distal end portion of the main ground electrode has an approximately flat end surface.

(4) The front end portion of the center electrode assumes the form of a cylindrical column having a radius of curvature of 0.5 mm or smaller.

In another preferred embodiment of the present invention, each of the auxiliary ground electrodes forms an auxiliary spark discharge gap between its distal end portion and the side surface of the front end portion of the center electrode so that a front end surface of the insulator is present in the auxiliary spark discharge gap; and, when gap imaginary lines of two auxiliary spark discharge gaps having the shortest distance from the main ground electrode as measured along the circumferential direction of the center electrode are depicted on a plane radially extending from the axis of the center electrode, the maximum distance F (mm) between the center point "a" of the main spark discharge gap and intersections "b1" and "b2" between the gap imaginary lines and an inner circumferential edge of the insulator is 1 to 3 mm.

The spark plug according to the present invention comprises a center electrode, an insulator, a metallic shell, a main ground electrode, and at least two auxiliary ground electrodes, and is characterized in that the main ground electrode is disposed so that its distal end portion faces a side surface of a front end portion of the center electrode and forms a main spark discharge gap between the distal end portion and the front end portion of the center electrode. Each of the auxiliary ground electrodes is disposed so that a portion of its distal end portion end surface faces an outer circumferential surface of a front end portion of the insulator, and the total area S ($mm^2$) satisfies an expression $S/Av<1.3$, which represents a relation between the total area S and the average gap distance Av (mm) of the main spark discharge gap.

The spark plug according to the present invention having the above-described characteristic features achieves the following effects when it is attached to an internal combustion engine. Even in a low temperature environment, a fuel bridge is unlikely to be formed, and, even when a fuel bridge is formed, the formed fuel bridge is less likely to be maintained. In addition, it is possible to prevent adhesion of carbon and accumulation of adhering carbon. Therefore, according to the present invention, there can be provided a spark plug which can improve the startability and sooting-up prevention performance of an internal combustion engine in a low temperature environment.

In preferred embodiments of the present invention, (1) the total area S ($mm^2$) satisfies an expression $0.25 \leqq S/Av \leqq 1$, which represents a relation between the total area S and the average gap distance Av (mm); (2) as viewed on a plane radially extending from an axis of the center electrode, a distance between a distal end portion end edge of the main ground electrode and a circumferential edge of the center electrode, as measured along an imaginary line connecting the axis and an axis of the main ground electrode, varies in a direction perpendicular to the imaginary line; (3) the distal end portion of the main ground electrode has an approximately flat end surface; and (4) the front end portion of the center electrode assumes the form of a cylindrical column having a radius of curvature of 0.5 mm or smaller. According to these preferred embodiments of the present invention, the startability of the internal combustion engine can be improved further.

In another preferred embodiment of the present invention, each of the auxiliary ground electrodes forms an auxiliary spark discharge gap between its distal end portion and the side surface of the front end portion of the center electrode so that a front end surface of the insulator is present in the auxiliary spark discharge gap. When gap imaginary lines of two auxiliary spark discharge gaps having the shortest distance from the main ground electrode as measured along the circumferential direction of the center electrode are depicted on a plane radially extending from the axis of the center electrode, the maximum distance F (mm) between the center point a of the main spark discharge gap and intersections b1 and b2 between the gap imaginary lines and the inner circumferential edge of the insulator is 1 to 3 mm. According to this preferred embodiment of the present invention, the sooting-up prevention performance of an internal combustion engine can be improved further.

BRIEF DESCRIPTION OF THE DRAWINGS

FIG. 2(*b*) is an enlarged plan view of a spark plug according to a preferred embodiment of the present invention, as viewed from the front end side.

FIG. 3(*b*) is an enlarged partial side view showing the opposing relation between the noble metal tip and the center-electrode noble metal tip when a spark plug according to a preferred embodiment of the present invention is viewed from the front end side of an axis CL1.

FIG. 6(*b*) is an enlarged partial view showing intersections between gap imaginary lines and the inner circumferential edge of the insulator in the spark plug according to a preferred embodiment of the present invention.

FIG. 6(*c*) is an enlarged partial view showing the maximum distance F (mm) in the spark plug according to a preferred embodiment of the present invention.

FIG. 8(*b*) is an enlarged plan view showing a modification of the arrangement of the auxiliary ground electrodes in which the auxiliary ground electrodes are disposed so that the main ground electrode and each auxiliary ground electrode adjacent thereto form a center angle of 120° therebetween.

DETAILED DESCRIPTION OF PREFERRED EMBODIMENT

Figure 1:
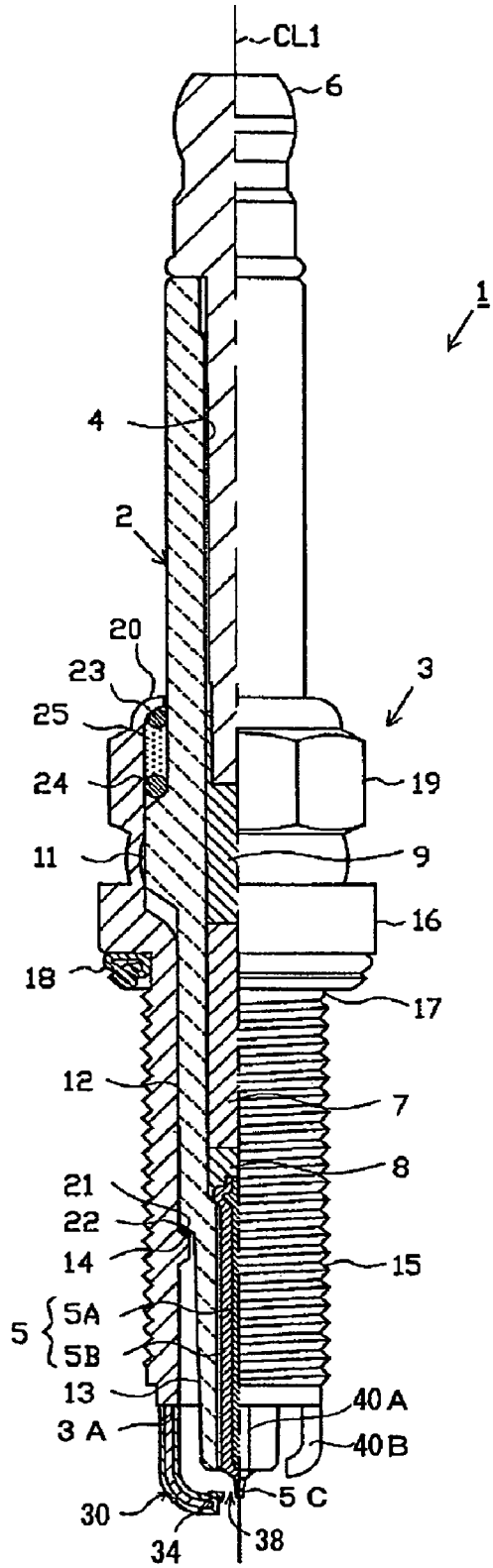
FIG. 1 is a partially sectioned front view of a spark plug according to a preferred embodiment of the present invention.
Figure 2A:
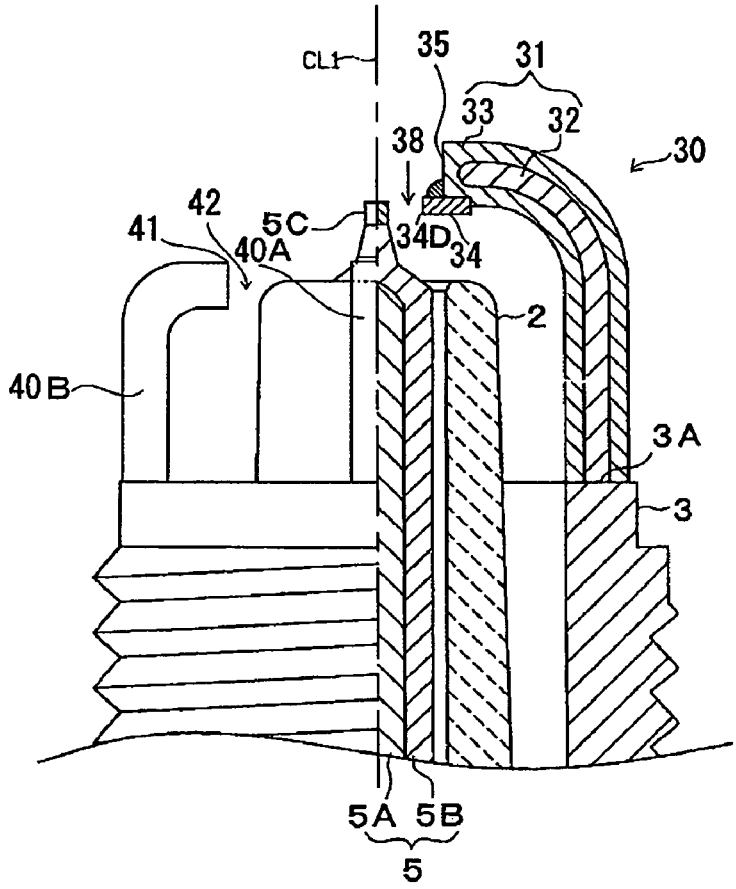
FIG. 2(*a*) is an enlarged partial view showing a front end portion of a spark plug according to a preferred embodiment of the present invention.
Figure 2B:
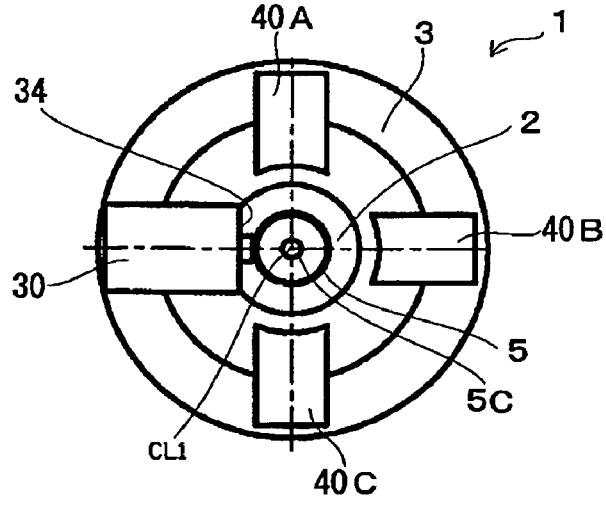

A spark plug which is one embodiment of the spark plug according to the present invention is shown in FIGS. 1 and 2. This spark plug 1 includes a rod-like center electrode 5 extending in the direction of an axis CL1. An approximately cylindrical tubular insulator 2 is provided on the outer circumference of the center electrode 5. An approximately tubular metallic shell 3 is provided on the outer circumference of the insulator 2. A main ground electrode 30 and three auxiliary ground electrodes 40A, 40B, 40C have proximal end portions that are joined to a front end surface 3A of the metallic shell 3. For the sake of convenience, in the spark plug 1 depicted in FIG. 1, the side toward one end portion of the metallic shell 3 at which the main ground electrode 30 is provided (for example, the lower side in FIG. 1) will be referred to as the "front end side," and the side toward the opposite end portion of the metallic shell 3 (for example, the upper side in FIG. 1) will be referred to as the "rear end side."

As shown in FIG. 1, the insulator 2 assumes an approximately cylindrical tubular shape extending in the direction of the axis CL1, and has an axial hole 4 which penetrates the insulator 2 along the axis CL1. The center electrode 5 is fixedly inserted into a front end portion of the axial hole 4. A terminal electrode 6 is fixedly inserted into a rear end portion of the axial hole 4. A resistor 7 is disposed in the axial hole 4 between the center electrode 5 and the terminal electrode 6. Opposite ends of the resistor 7 are electrically connected to the center electrode 5 and the terminal electrode 6, respectively, via electrically conductive glass seal layers 8 and 9.

As shown in FIGS. 1 and 2, the center electrode 5 is reduced in diameter at its front end, and assumes, as a whole, the form of an approximately cylindrical rod extending in the axial direction. The front end surface of the center electrode 5 is rendered flat. A front end portion of the center electrode 5 projects from the front end of the insulator 2. The center electrode 5 is comprised of an inner layer 5A formed of copper or a copper alloy, and an outer layer 5B formed of a nickel alloy. A noble metal tip (in the present invention, may be referred as the "center-electrode noble metal tip") 5C containing iridium as the main component is joined to the front end surface of the center electrode 5 through welding. Such a center electrode 5 can be said to be composed of a center electrode main body, which is formed by the inner layer 5A and the outer layer 5B, and the center-electrode noble metal tip 5C. When the center electrode 5 has the center-electrode noble metal tip 5C, the durability of the center electrode 5; i.e., the durability of the spark plug 1, is improved. This center-electrode noble metal tip 5C is formed into a cylindrical columnar shape, and joined to the front end surface of the center electrode 5.

A front end portion of the center electrode 5 (in the present example, the center-electrode noble metal tip 5C) has a radius of curvature r of 0.5 mm or smaller. When the front end portion of the center electrode 5; i.e., the center-electrode noble metal tip 5C, has a radius of curvature r of 0.5 mm or smaller, the startability of an internal combustion engine can be improved further.

The insulator 2 is formed from alumina or the like through firing. The insulator 2 includes a flange-shaped large diameter portion 11 projecting radially outward at an approximately center portion thereof with respect to the direction of the axis CL1 of the spark plug 1. An intermediate trunk portion 12 is formed on the front end side of the large diameter portion 11 and has a diameter smaller than that of the large diameter portion 11. A leg portion 13 is formed on the front end side of the intermediate trunk portion 12 and has a diameter smaller than that of the intermediate trunk portion 12. The leg portion 13 is disposed within a combustion chamber of an internal combustion engine. A front end portion of the insulator 2, including the large diameter portion 11, the intermediate trunk portion 12, and the leg portion 13, is accommodated within the metallic shell 3, which is formed into a tubular shape. A step portion 14 is formed at a connection portion between the leg portion 13 and the intermediate trunk portion 12. The insulator 2 is engaged with the metallic shell 3 at the step portion 14.

The metallic shell 3, which extends in the axial direction and assumes an approximately tubular shape, is formed of metal such as low carbon steel and has a tubular shape. A thread portion (in the present example, an external thread portion) 15 for mounting the spark plug 1 onto the engine head of the internal combustion engine is formed on the outer circumferential surface of the metallic shell 3. A seat portion 16 is formed on the outer circumferential surface of the metallic shell 3 to be located on the rear end side of the thread portion 15. A ring-shaped gasket 18 is fitted into a thread neck potion 17 at the rear end of the thread portion 15. A tool engagement portion 19 and a crimped portion 20 are provided at the rear end of the metallic shell 3. The tool engagement portion 19 has a hexagonal cross section, and a tool, such as a wrench, is engaged with the tool engagement portion 19 when the metallic shell 3 is mounted to the cylinder head. The crimped portion 20 holds the insulator 2 at a rear end portion thereof.

Furthermore, a step portion 21 with which the insulator 2 is engaged is provided on the inner circumferential surface of the metallic shell 3. The insulator 2 is inserted into the metallic shell 3 from its rear end side toward the front end side. In a state in which the step portion 14 of the insulator 2 is engaged with the step portion 21 of the metallic shell 3, a rear-end-side opening portion of the metallic shell 3 is crimped radially inward; i.e., the above-mentioned crimped portion 20 is formed, whereby the insulator 2 is fixed. Notably, an annular plate packing 22 is interposed between step portion 14 of the insulator 2 and step portion 21 of the metallic shell 3. Thus, the airtightness of a combustion chamber is secured, whereby an air-fuel mixture which enters the clearance between the inner circumferential surface of the metallic shell 3 and the leg portion 13 of the insulator 2 exposed to the interior of the combustion chamber is prevented from leaking to the outside.

Moreover, in order to render the sealing by the crimping more perfect, on the rear end side of the metallic shell 3, annular ring members 23 and 24 are interposed between the metallic shell 3 and the insulator 2, and powder of talc 25 is charged into the space between the ring members 23 and 24. That is, the metallic shell 3 holds the insulator 2 via the plate packing 22, the ring members 23 and 24, and the talc 25.

As shown in FIGS. 1 and 2, the main ground electrode 30, which is bent into a generally L-like shape, is joined to the front end surface 3A of the metallic shell 3 by means of welding or the like. That is, a proximal end portion of the main ground electrode 30 is joined to the front end surface 3A of the front end portion of the metallic shell 3 by means of welding or the like. The main ground electrode 30 is bent toward the axis CL1 in the vicinity of an intermediate portion thereof, and is disposed so that the distal end portion of the main ground electrode 30 faces the side surface of the front end portion of the center electrode 5; i.e., the peripheral surface of the center-electrode noble metal tip 5C. In this manner, a main spark discharge gap 38 is formed between the distal end portion of the main ground electrode 30 and the front end portion of the center electrode 5. Thus, in the spark plug 1, spark discharge occurs at the main spark discharge gap 38 approximately along a direction perpendicular to the axis CL1. This main ground electrode 30 has an approximately rectangular cross section as viewed perpendicular to the axis thereof.

In the embodiment shown in FIG. 2*a*, the main ground electrode 30 is comprised of a generally L-shaped main ground electrode main body 31, and a noble metal tip 34 joined to a distal end portion of the main ground electrode main body 31. Since the noble metal tip 34 is provided at the distal end of the main ground electrode 30, the durability of the main ground electrode 30; i.e., the durability of the spark plug 1, is improved.

As shown in FIGS. 1 and 2, the main ground electrode main body 31 has a double layer structure composed of an inner layer 32 and an outer layer 33. The outer layer 33 is formed of a nickel alloy such as Inconel 600 or Inconel 601, both of which are registered trademarks. The inner layer 32 is formed of pure copper or a copper alloy, which is a metal of higher heat conductivity than the above-mentioned nickel alloy. Since the main ground electrode main body 31 is configured in this manner, heat transmission performance can be improved.

Figure 3A:
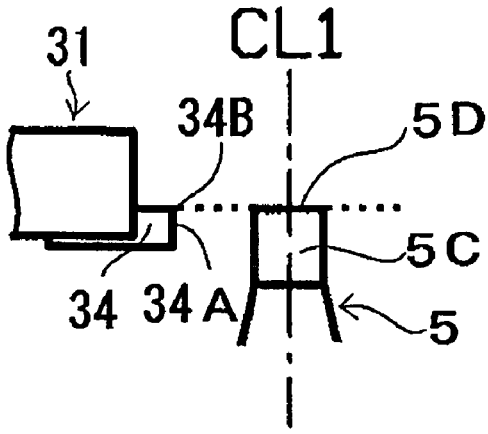
FIG. 3(*a*) is an enlarged partial side view showing the opposing relation between a noble metal tip and a center-electrode noble metal tip when a spark plug according to a preferred embodiment of the present invention is viewed from a side thereof.
Figure 3B:
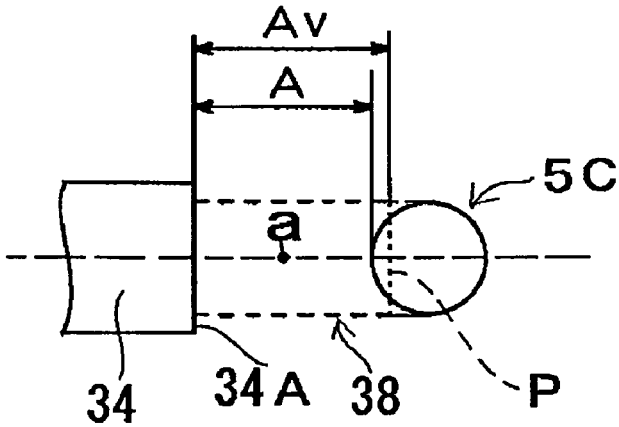

As shown in FIG. 2, the noble metal tip 34 assumes the form of a prism. The noble metal tip 34 is joined to the main ground electrode main body 31 so that a portion of the noble metal tip 34 is embedded in the main ground electrode main body 31, and the noble metal tip 34 projects toward the center electrode 5 from a distal end surface 35 of the main ground electrode main body 31. As shown in FIG. 3(*a*), etc., the main ground electrode 30 (in this example, the noble metal tip 34) has, at its distal end portion, a distal end portion end surface 34A, which is substantially flat. This distal end portion end surface 34A faces the peripheral surface of the center-electrode noble metal tip 5C. Since the noble metal tip 34 has the distal end portion end surface 34A, the startability of the internal combustion engine can be improved further. Notably, the distal end portion end surface 34A is not necessarily required to have a high degree of flatness, and may have a surface profile wherein the distance between the end edge of the distal end portion of the main ground electrode 30 and the circumferential edge of the center electrode 5 is variable, as will be described later.

Accordingly, in this example, the main spark discharge gap 38 is formed between the noble metal tip 34 of the main ground electrode 30 and the peripheral surface of the center-electrode noble metal tip 5C, and has a gap distance A (mm). The gap distance A (mm) is the shortest distance between the distal end portion end surface of the main ground electrode 30 and the peripheral surface of the center electrode 5. As shown in FIG. 3(*b*), in the present example, the gap distance A (mm) is the shortest distance between the distal end portion end surface 34A of the noble metal tip 34 and the peripheral surface of the center electrode 5 as measured along a straight line passing through their axes, and is typically adjusted to about 0.8 to 1.3 mm.

The opposing relation between the noble metal tip 34 and the center-electrode noble metal tip 5C in the spark plug 1 will be described with reference to drawings.

In the spark plug 1, the distal end portion end surface 34A of the noble metal tip 34 and the peripheral surface of the center-electrode noble metal tip 5C are disposed to face each other so that, as viewed from the side surface of the spark plug 1 as shown in FIG. 3(*a*), an end edge 34B of the distal end portion end surface 34A of the noble metal tip 34, located on the front end side with respect to the direction of the axis CL1, and an end edge 5D of the peripheral surface of the center-electrode noble metal tip 5C, located on the front end side with respect to the direction of the axis CL1 (i.e., the front end surface of the center-electrode noble metal tip 5C) are present substantially in a common plane. Furthermore, the distal end portion end surface 34A of the noble metal tip 34 and the peripheral surface of the center-electrode noble metal tip 5C are disposed to face each other so that, as viewed from the front end side of the spark plug 1 as shown in FIG. 3(*b*), the center axis of the noble metal tip 34 passes through the center axis of the center-electrode noble metal tip 5C; i.e., the center axis of the noble metal tip 34 and the center axis of the center-electrode noble metal tip 5C are present on a common straight line.

In the spark plug 1, the main ground electrode 30 and the center electrode 5 are disposed so that a total area S ($mm^2$) satisfies an expression $S/Av<1.3$, which represents a relation between the total area S and an average gap distance Av (mm) of the main spark discharge gap, where the total area S is the sum of a projection area C ($mm^2$) and a projection area D ($mm^2$). Projection area C ($mm^2$) is a portion of the distal end portion of the main ground electrode 30 which overlaps with a projected region 5F of the front end portion of the center electrode 5 when the distal end portion of the main ground electrode 30 and the front end portion of the center electrode 5 are projected along a radial direction of the center electrode 5. Projection area D ($mm^2$) is s a portion of the front end portion of the center electrode 5 which overlaps with a projected region 36 of the distal end portion of the main ground electrode 30 when the distal end portion of the main ground electrode 30 and the front end portion of the center electrode 5 are projected along the radial direction of the center electrode 5. In the case where the distal end portion end surface of the main ground electrode 30 and/or the peripheral surface of the center electrode 5 is a curved surface, the average gap distance Av (mm) is the distance of a gap formed between the main ground electrode 30 and the center electrode 5 in a state in which each of the distal end portion end surface of the main ground electrode 30 and the peripheral surface of the center electrode 5 is rendered flat if curved; i.e., the distance of a gap formed between the main ground electrode 30 and the center electrode 5 under the assumption that the distal end portion end surface of the main ground electrode 30 and the peripheral surface of the center electrode 5, which face each other, are rendered flat with their volumes maintained constant. In the present example, as described above, the front end portion of the center electrode 5 is the center-electrode noble metal tip 5C, and the distal end portion of the main ground electrode 30 is the noble metal tip 34. Therefore, as shown in, for example, FIG. 3(*b*), the average gap distance Av (mm) is the distance between the distal end portion end surface 34A of the noble metal tip 34 and a plane P assumed as follows. The peripheral surface of the center-electrode noble metal tip 5C is deformed with its volume maintained constant so that the center-electrode noble metal tip 5C has a flat surface which faces the distal end portion end surface 34A of the noble metal tip 34. This flat surface is assumed as the plane P.

Figure 4:
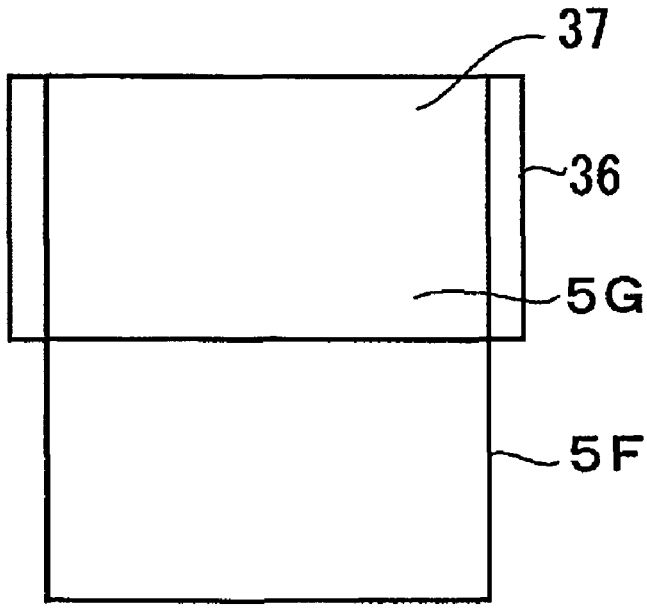
FIG. 4 is a projection view showing a projected region of the noble metal tip and a projected region of the center-electrode noble metal tip, which are obtained by projecting the noble metal tip and the center-electrode noble metal tip in a radial direction of the center electrode in a spark plug according to a preferred embodiment of the present invention.

The opposing relation between the center-electrode noble metal tip 5C and the noble metal tip 34 will be described more specifically. FIG. 4 shows the projected region 36 of the noble metal tip 34 and the projected region 5F of the center-electrode noble metal tip 5C, which are obtained through projection of the distal end portion of the main ground electrode 30 (i.e., the noble metal tip 34) and the front end portion of the center electrode 5 (i.e., the center-electrode noble metal tip 5C) in a radial direction of the center electrode 5. In this projection, the projection area of a projected portion 37, which is a portion of the projected region 36 overlapping with the projected region 5F of the center-electrode noble metal tip 5C, is represented by C ($mm^2$). The projection area of a projected portion 5G, which is a portion of the projected region 5F overlapping with the projected region 36 of the noble metal tip 34, is represented by D ($mm^2$). The projected portion 37 can also be said to be a projected region obtained by projecting a region of the distal end portion end surface 34A of the noble metal tip 34 facing the center electrode 5 in the above-described manner. Similarly, the projected portion 5G can also be said to be a projected region obtained by projecting a region of the peripheral surface of the center-electrode noble metal tip 5C facing the noble metal tip 34 in the above-described manner (see, for example, FIG. 3(*b*)). In this example, the projected portion 37 and the projected portion 5G have the same area. The projection area C ($mm^2$) of the projected portion 37 and the projection area D ($mm^2$) of the projected portion 5G are calculated in a conventional manner, and the total area S ($mm^2$) of the projection area C ($mm^2$) and the projection area D ($mm^2$) are calculated. The total area S ($mm^2$) calculated in this manner satisfies an expression $S/Av<1.3$, which represents the relation between the total area S ($mm^2$) and the average gap distance Av (mm). When the total area S ($mm^2$) satisfies this relational expression, a fuel bridge becomes unlikely to be formed and held between the center-electrode noble metal tip 5C and the noble metal tip 34, whereby the startability of an internal combustion engine in a low temperature environment can be improved. Preferably, the ratio (S/Av) satisfies $0.25 \leqq S/Av \leqq 1$, because the startability of an internal combustion engine in a low temperature environment can be improved further.

In the spark plug 1, the main ground electrode 30 and the center electrode 5 are arranged or formed so that, as viewed on a plane radially extending from the axis of the center electrode 5, the distance between the distal end portion end edge of the main ground electrode 30 and the circumferential edge of the center electrode 5, as measured along an imaginary line connecting the above-mentioned axis and the axis of the main ground electrode 30, varies in a direction perpendicular to the imaginary line.

Figure 5:
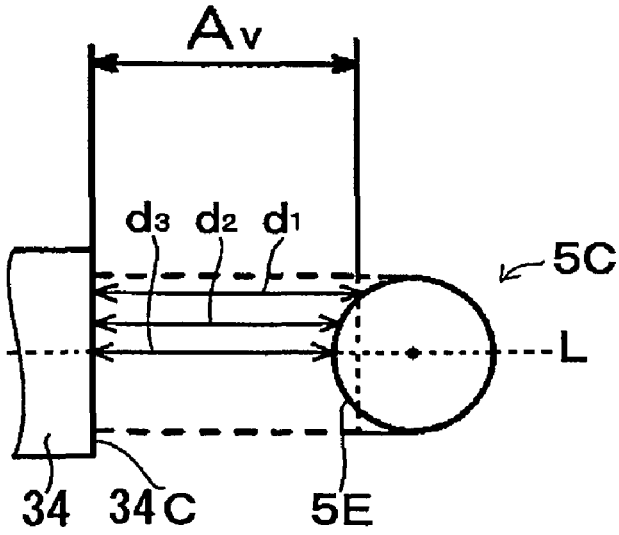
FIG. 5 is a view showing that the distance between a front end portion end edge of the noble metal tip and the peripheral edge of the center-electrode noble metal tip is not constant when the spark plug according to a preferred embodiment of the present invention is viewed from the front end side of the axis CL1.

This will be described more specifically. As shown in FIG. 5, on a plane radially extending from the axis of the center-electrode noble metal tip 5C; i.e., a cross section of the spark plug 1 perpendicular to the axis CL1, there are assumed a plurality of distances do between the distal end portion end edge 34C of the noble metal tip 34 and the peripheral edge 5E of the center-electrode noble metal tip 5C along an imaginary line L connecting the above-mentioned axis and the axis of the noble metal tip 34, the distances being those at a plurality of locations along a direction perpendicular to the imaginary line L. For example, distances d1, d2, and d3 are assumed as shown in FIG. 5. The noble metal tip 34 and the center-electrode noble metal tip 5C are arranged or formed so that the plurality of distances at the plurality of locations along the direction perpendicular to the imaginary line L differ from one another (for example, $d1 \neq d2 \neq d3$). In the case where the noble metal tip 34 and the center-electrode noble metal tip 5C are arranged or formed in this manner, the startability of an internal combustion engine in a low temperature environment can be improved.

In the spark plug 1, the noble metal tip 34 assumes the form of a prism, and the center-electrode noble metal tip 5C assumes the form of a cylindrical column. Therefore, the distance do between the flat distal end portion end surface 34A of the noble metal tip 34 and the curved peripheral surface 5E of the center-electrode noble metal tip 5C varies along the direction perpendicular to the imaginary line L.

As shown in FIGS. 1 and 2, the three auxiliary ground electrodes 40A, 40B, and 40C, which are bent in a generally L-like shape, are joined to the front end surface 3A of the metallic shell 3 by means of welding or the like. That is, proximal end portions of the auxiliary ground electrodes 40A, 40B, and 40C are joined to the front end surface 3A of a front end portion of the metallic shell 3 by means of welding or the like. As shown in FIG. 2(*b*), the three auxiliary ground electrodes 40A, 40B, and 40C and the main ground electrode 30 are arranged so that the ground electrodes are equally spaced from the main ground electrode 30 or the respective auxiliary ground electrode 40A, 40B, 40C adjacent thereto. In other words, the three auxiliary ground electrodes 40A, 40B, and 40C and the main ground electrode 30 are arranged substantially symmetrically so that adjacent electrodes form a center angle of about 90° about the axis CL1.

As shown in FIG. 2(*a*), each of the auxiliary ground electrodes 40A, 40B, and 40C (in the present invention, these electrodes may be collectively referred to as the auxiliary ground electrode 40) is bent toward the axis CL1 in the vicinity of an intermediate portion thereof, and is disposed so that a portion of the distal end portion end surface of the auxiliary ground electrode 40 faces the outer circumferential surface of a front end portion of the insulator 2. In other words, the distal end portion of the auxiliary ground electrode 40 is disposed so that, when the auxiliary ground electrode 40 is projected onto the insulator 2 (for example, along an imaginary line connecting the above-mentioned axis CL1 and the axis of the auxiliary ground electrode 40), a portion of the projected region of the distal end portion end surface of the auxiliary ground electrode 40 is projected on the outer circumferential surface of the insulator 2. As shown in FIG. 2(*b*), the distal end portion end surface of the auxiliary ground electrode 40 is formed into a concave surface which is recessed toward the interior of the auxiliary ground electrode 40. This curved surface has a radius of curvature such that the distance between the concave surface and the outer circumferential surface of the insulator 2 is maintained constant along the circumferential direction. In this manner, the distal end portion end surface of the auxiliary ground electrode 40 and the side surface of the front end portion of the center electrode 5 form an auxiliary spark discharge gap 42 in which the front end surface of the insulator 2 is present. As described above, in the spark plug 1, spark discharge is generated, via the front end surface of the insulator 2, at the auxiliary spark discharge gap 42 approximately along a direction perpendicular to the axis CL1. As a result, the spark plug 1 can improve the sooting-up prevention performance of an internal combustion engine in a low temperature environment. The gap distance between the outer circumferential surface of the insulator 2 and the auxiliary ground electrode 40 at the auxiliary spark discharge gap 42 is typically adjusted to about 0.4 to about 0.8 mm. Although not illustrated, like the main ground electrode 30, the auxiliary ground electrode 40 has a double layer structure, and has an approximately rectangular cross section as taken perpendicular to the axis thereof.

As shown in FIG. 2(*a*), preferably, an end edge 41 of the distal end portion end surface of the auxiliary ground electrode 40 located on the front end side with respect to the direction of the axis CL1 is located rearward (with respect to the direction of the axis CL1) of an end edge 34D of the distal end portion end surface 34A of the main ground electrode 30 (i.e., the noble metal tip 34) located on the rear end side with respect to the direction of the axis CL1.

In the spark plug 1, the main ground electrode 30, the auxiliary ground electrodes 40A, 40B, and 40C, the center electrode 5, etc. are arranged and formed as follows. On a plane radially extending from the axis of the center electrode 5, there are depicted gap imaginary lines of two auxiliary spark discharge gaps 42 having the shortest distance from the main ground electrode 30, as measured in the circumferential direction of the center electrode 5. The intersections between the gap imaginary lines and the inner circumferential edge of the insulator 2 are represented by b1 and b2, respectively, and the center point of the main spark discharge gap 38 is represented by a. The main ground electrode 30, the auxiliary ground electrodes 40A, 40B, and 40C, the center electrode 5, etc. are arranged and formed so that the maximum distance F (mm) between the center point a and the intersections b1 and b2 becomes 1 to 3 mm.

Figure 6A:
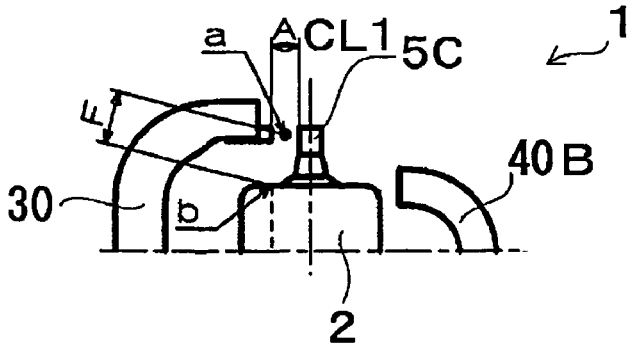
FIG. 6(*a*) is an enlarged partial view showing the center point of the main spark discharge gap in the spark plug according to a preferred embodiment of the present invention.
Figure 6B:
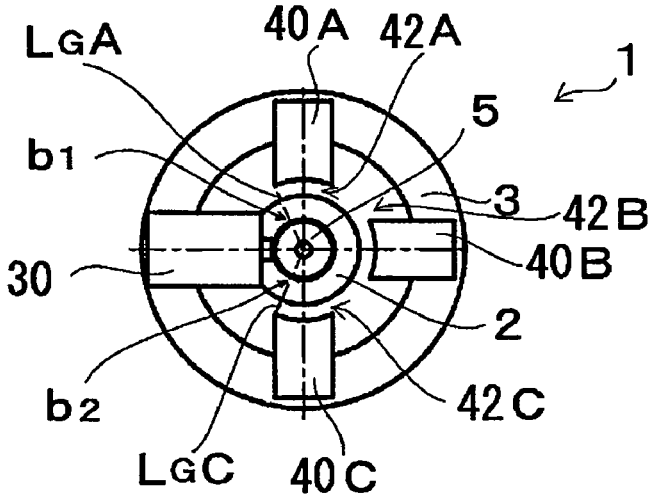
Figure 6C:
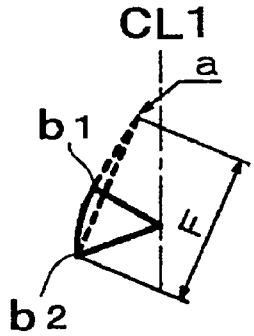

More specifically, as shown in FIG. 3(*b*) and FIG. 6(*a*), the center point (i.e., the centroid) of the main spark discharge gap 38 is represented by a. Meanwhile, as shown in FIG. 6(*b*), on a plane radially extending from the axis of the center electrode 5, two auxiliary spark discharge gaps 42 having the shortest distance from the main ground electrode 30, as measured in the circumferential direction of the center electrode 5, are specified. In this example, as shown in FIG. 6(*b*), the two auxiliary spark discharge gaps are auxiliary spark discharge gaps 42A and 42C formed between the auxiliary ground electrodes 40A and 40C and the center electrode 5. Subsequently, at the two auxiliary spark discharge gaps 42A and 42C, gap imaginary lines $L_G$ having the shortest distance from the main ground electrode 30 as measured in the circumferential direction are assumed. In this example, as shown in FIG. 6(*b*), the gap imaginary lines $L_G$ having the shortest distance are gap imaginary lines $L_G$A and $L_G$C which connect the center of the center electrode 5 and end portions of the auxiliary ground electrodes 40A and 40C located on the side toward the main ground electrode 30. Subsequently, the intersections between the gap imaginary lines $L_G$A and $L_G$C and the inner circumferential edge of the insulator 2 are represented by "b1" and "b2," respectively; and the distances between the center point "a" and the intersections "b1" and "b2" are determined. As shown in FIG. 6(*c*), the maximum distance of the distances ab1 and ab2 determined in this manner is represented by F. In this example, since the main ground electrode 30 and the auxiliary ground electrodes 40A, 40B, and 40C are disposed at constant intervals as described above, the distances ab1 and ab2 are the same.

In the spark plug 1, the main ground electrode 30, the auxiliary ground electrodes 40A, 40B, and 40C, the center electrode 5, etc. are arranged and formed so that the maximum distance F determined in this manner becomes 1 to 3 mm. When the maximum distance F falls within a range of 1 to 3 mm, the sooting-up prevention performance of an internal combustion engine can be improved further. Therefore, the spark plug 1 is excellent in terms of igniting performance and fouling resistance. Preferably, the maximum distance F falls within a range of 1.5 to 2.5 mm, because the spark plug 1 becomes more excellent in terms of igniting performance and fouling resistance.

Next, a method of manufacturing the spark plug according to the present invention will be described, while the above-mentioned spark plug 1 is taken as an example.

First, the metallic shell 3 is fabricated. That is, cold forging operation is performed on a cylindrical columnar metal material so as to form a through hole therein. Subsequently, cutting operation is performed on the metal material so as to impart a predetermined outer shape, whereby a metallic shell intermediate is obtained. Examples of the metal material include, by way of example and not limitation, iron materials such as S17C and S25C, and stainless steel.

An intermediate of the main ground electrode 30 is fabricated. This intermediate is a straight-bar-like member which has not yet been bent. The main ground electrode 30 which has not been bent can be fabricated as follows. That is, there are prepared a core material formed of a metal material and constituting the inner layer 32. A tubular member having a bottom at one end (i.e., a closed end) is formed of a metal material and constituting the outer layer 33. The core material is fitted into a recess portion of the bottomed tubular member, whereby a cup member is formed. Cold thinning work is performed on this double-layer cup member. Examples of the cold thinning work include wire drawing in which a die or the like is used, and extrusion in which a female die or the like is used. Subsequently, swaging or the like is performed, whereby a bar-like member having a reduced diameter is formed.

Respective intermediates of the auxiliary ground electrodes 40A, 40B, and 40C are fabricated in a manner which is basically the same as that for the intermediate of the main ground electrode 30. Notably, the respective intermediates of the auxiliary ground electrodes 40A, 40B, and 40C are formed to have an axial length shorter than that of the intermediate of the main ground electrode 30 by a predetermined amount.

The intermediate of the main ground electrode 30 and the intermediates of the auxiliary ground electrodes 40A, 40B, and 40C are joined to the front end surface of the metallic shell intermediate by means of resistance welding. Since a so-called "slag" is produced as a result of performance of resistance welding, an operation for removing the "slag" is performed.

The intermediate of the main ground electrode 30 and the intermediates of the auxiliary ground electrodes 40A, 40B, and 40C may be resistance-welded to the metallic shell intermediate after having undergone swaging, cutting, etc. Alternately, swaging, cutting, etc. may be performed on these intermediates after they are joined to the metallic shell intermediate. In latter case, in a state in which the metallic shell intermediate is held, each of the intermediates joined to the front end surface thereof can be inserted, from its distal end, into a machining section (swaging die) of a swaging machine. Therefore, it becomes unnecessary to increase the length of each intermediate so as to secure a portion to be held during swaging.

Subsequently, the thread portion 15 is formed on the metallic shell intermediate at a predetermined position through rolling. Thus, the metallic shell 3 having the intermediates welded thereto is obtained. Zinc plating or nickel plating is performed for the metallic shell 3, etc. Notably, in order to increase corrosion resistance, the surfaces of the metallic shell, etc. may be treated with chromate.

The noble metal tip 34 and the center-electrode noble metal tip 5C are fabricated as follows, for example. First, an ingot including iridium or platinum as the main component is prepared, and the ingot and alloy components are mixed and melted to obtain the above-described predetermined composition. An ingot is again formed from the melted alloy, and hot forging and hot rolling (rolling with a grooved roll) are performed on the ingot. After that, the resultant member is drawn so as to obtain a bar-shaped material. This bar-shaped material is cut to a predetermined length, whereby the cylindrical columnar center-electrode noble metal tip 5C and the prismatic noble metal tip 34 can be fabricated.

The noble metal tip 34 fabricated in this manner is joined to a distal end portion of the intermediate of the main ground electrode 30 by means of resistance welding. At that time, a cut groove or the like is not formed on the intermediate of the main ground electrode 30, and the noble metal tip 34 is joined by means of performing resistance welding, while pressing the noble metal tip 34 against the distal end portion end surface of the intermediate of the main ground electrode 30, so that the noble metal tip 34 intrudes into the distal end portion end surface by an amount of 0.3 mm or greater. Notably, in order to perform welding more reliably, a plating layer may be removed from the area to be welded before the welding occurs. Alternatively, in a plating step, masking or the like is provided on a region where welding is expected to performed. Furthermore, welding of the noble metal tip 34 may be performed after assembly to be described later.

The insulator 2 is formed. For example, material granules for molding are prepared from material powder containing alumina (predominant component), binder, etc. A cylindrical compact is obtained by performing rubber press molding while using the material granules. Grinding is performed on the obtained compact for trimming. The trimmed compact is fired, whereby the insulator 2 is fabricated.

Further, separately from the metallic shell 3 and the insulator 2, the center electrode 5 is fabricated. That is, a nickel alloy is forged, and a copper core is placed at a center portion thereof in order to improve heat radiation performance. Thus, the main body of the center electrode 5 is fabricated. Subsequently, the center-electrode noble metal tip 5C is placed on the front end surface of the main body and is joined thereto by means of resistance welding, laser welding, electron beam welding, or the like.

The center electrode 5, which has been fabricated as described above, and the terminal electrode 6 are fixedly inserted into the axial hole 4 of the insulator 2 in a sealed condition, by means of an unillustrated glass seal. In general, the glass seal is formed as follows. A powder mixture for the glass seal is prepared by mixing borosilicate glass powder and metal powder. After the center electrode 5 is inserted into the axial hole 4 of the insulator 2, the prepared powder mixture is charged into the axial hole 4 of the insulator 2. Subsequently, the terminal electrode 6 is inserted and pressed from the rear side. In this state, the powder mixture is baked within a firing furnace. Notably, at that time, a glaze layer may be simultaneously formed on the surface of the rear-end-side trunk portion of the insulator 2 through firing. Alternatively, the glaze layer may be formed in advance.

After that, the metallic shell 3 and the insulator 2 carrying the fabricated center electrode 5 and the terminal electrode 6 are assembled together. More specifically, cold crimping or hot crimping is performed on a rear end portion of the metallic shell 3 that has a relatively small wall thickness, whereby a portion of the insulator 2 is circumferentially surrounded and held by the metallic shell 3.

Next, the straight intermediate of the main ground electrode 30 and the straight intermediates of the auxiliary ground electrode 40A, 40B, and 40C are bent such that the distal end portion of each intermediate faces the center-electrode noble metal tip 5C or the insulator 2 as described above, and the main spark discharge gap 38 and the auxiliary spark discharge gaps 42 are adjusted, whereby the spark plug 1 is manufactured.

Since the spark plug according to the present invention has the above-described characteristic feature, the startability and sooting-up prevention performance of an internal combustion engine in a low temperature environment can be improved.

The spark plug of the present invention is used as an ignition plug for an internal combustion engine, such as a gasoline engine, for automobiles. The thread portion 15 of the spark plug is screwed into a threaded hole provided in a head (not shown) which defines or forms combustion chambers of the internal combustion engine, whereby the spark plug is fixed at a predetermined position. Although the spark plug of the present invention can be used for internal combustion engines of any type, the spark plug is suitable for direct-injection-type internal combustion engines, and internal combustion engines used in a low temperature environment.

Figure 7:
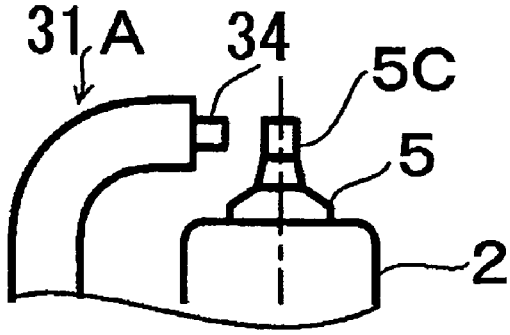
FIG. 7 is an enlarged partial view showing a modification of the joining of the noble metal tip joined to the distal end portion end surface of the main ground electrode in the spark plug according to a preferred embodiment of the present invention.

The spark plug according to the present invention is not limited to the above-described embodiment, and can be changed in various manners within a range in which the object of the present invention can be achieved. For example, in the above-described embodiment, as shown in FIG. 2(*a*), the noble metal tip 34 is joined to the distal end surface 35 of the main ground electrode main body 31 in the vicinity of an end edge thereof located on the front end side with respect to the direction of the axis CL1. However, in the present invention, it is sufficient for the noble metal tip to face the front end portion of the center electrode as described above, and the noble metal tip 34 may be joined to an approximately center portion of the distal end portion end surface of the main ground electrode main body 31A as shown in FIG. 7.

The main ground electrode 30 has the noble metal tip 34 at its distal end portion. In the present invention, the main ground electrode is not necessarily required to have the noble metal tip. In such a case, the distal end portion of the main ground electrode is disposed to face the center electrode or the center-electrode noble metal tip as described above.

Figure 8A:
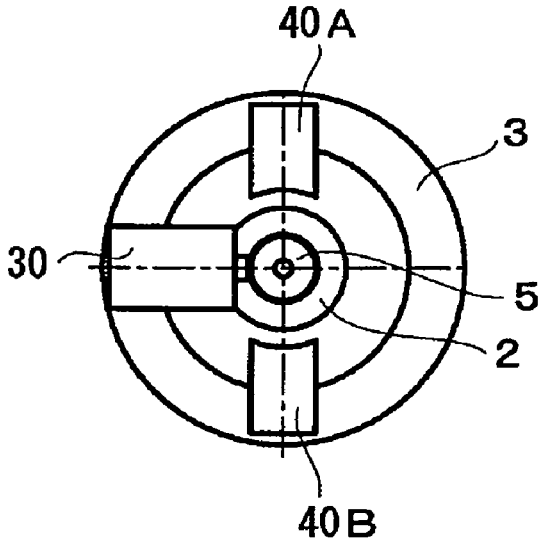
FIG. 8(*a*) is an enlarged plan view showing a modification of the arrangement of the auxiliary ground electrodes in which the auxiliary ground electrodes are disposed so that the main ground electrode and each auxiliary ground electrode adjacent thereto form a center angle of 90° therebetween.
Figure 8B:
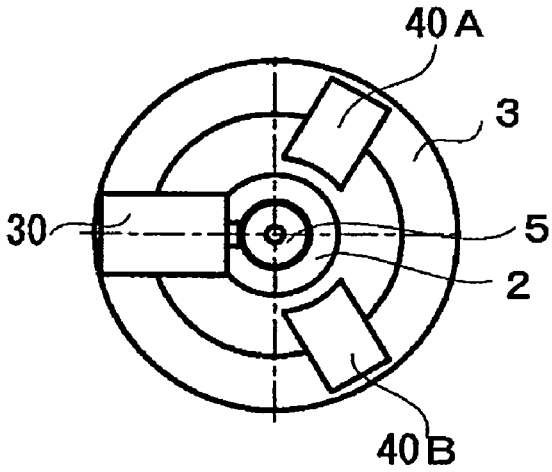

The spark plug 1 has the three auxiliary ground electrodes 40A, 40B, and 40C. However, in the present invention, the spark plug may have two auxiliary ground electrodes, or four or more auxiliary ground electrodes. In the case where the spark plug of the present invention has two auxiliary ground electrodes, the auxiliary ground electrodes 40A and 40B may be disposed so that a center angle of 90° is formed between each of the auxiliary ground electrodes 40A and 40B and the main ground electrode 30 as shown in FIG. 8(*a*), or a center angle of 120° is formed between each of the auxiliary ground electrodes 40A and 40B and the main ground electrode 30 as shown in FIG. 8(*b*).

In the spark plug 1, as shown in FIG. 2(*b*), the auxiliary ground electrodes 40 are disposed so that they become substantially symmetrical with respect to a plane including the axis CL1 of the spark plug 1 and the axis of the main ground electrode 30. However, in the present invention, the auxiliary ground electrodes may be disposed asymmetrically with respect to that plane. Furthermore, in the present invention, each of the auxiliary ground electrodes may have a noble metal tip at a distal end thereof.

The proximal end portions of the main ground electrode 30 and the auxiliary ground electrodes 40 are joined to the front end surface 3A of the front end portion of the metallic shell 3. However, in the present invention, the proximal end portions of the main ground electrode 30 and the auxiliary ground electrodes 40 may be joined to the circumferential side surface of the front end portion of the metallic shell 3 in the vicinity of the front end surface thereof.

The main ground electrode 30 and the auxiliary ground electrodes 40 have a double-layer structure. However, in the present invention, the main ground electrode 30 and the auxiliary ground electrodes 40 may have a single-layer structure, a triple-layer structure, or a multi-layer structure having four or more layers. In the case where the main ground electrode and the auxiliary ground electrodes have a single-layer structure, a metal material such as nickel can be used to produce them. In the case where the main ground electrode and the auxiliary ground electrodes have a multi-layer structure, preferably, an inner layer is formed of a metal material which is higher in heat conductivity than an outer layer.

In the embodiment, the main ground electrode 30 and the auxiliary ground electrodes 40 each have a rectangular cross section. However, in the present invention, the cross sectional shapes of the main ground electrode and the auxiliary ground electrodes are not limited to the rectangular shape, and may be a polygonal shape, an elliptical shape, a trapezoidal shape, an oval shape, or a shape formed by removing a portion of a circular area such that the electrode has a flat surface.

In the spark plug 1, the distance dn, which is variable, is formed between the flat distal end portion end surface 34A of the noble metal tip 34 and the curved peripheral surface of the center-electrode noble metal tip 5C. However, in the present invention, in order to make the distance dn variable, the distal end portion end surface of the main ground electrode or the noble metal tip is not necessarily required to be a flat surface, and the side surface of the center electrode or the center-electrode noble metal tip is not necessarily required to be a curved surface. For example, the distal end portion end surface of the main ground electrode or the noble metal tip may be a convex surface projecting toward the center electrode, or a concave surface recessed toward the interior of the main ground electrode or the noble metal tip; and the distal side portion end surface of the center electrode or the center-electrode noble metal tip may be a flat surface or a concave surface recessed toward the interior of the center electrode or the center-electrode noble metal tip.

The noble metal tip 34 is formed of a noble metal alloy containing platinum as the main component and 20 wt. % of rhodium. However, in the present invention, the noble metal tip is not limited to that formed of a noble metal alloy containing platinum as the main component, and may be formed of iridium or an alloy containing iridium as the main component.

The center electrode 5 has the center-electrode noble metal tip 5C at its front end portion. However, in the present Invention, the center electrode is not necessarily required to have the center-electrode noble metal tip. In such a case, the center electrode is formed to have a reduced diameter in the vicinity of the front end thereof, and is disposed so that the front end portion of the center electrode faces the distal end portion of the main ground electrode as described above. The center-electrode noble metal tip 5C has a cylindrical columnar shape. However, in the present invention, the center-electrode noble metal tip 5C may be formed into an elliptical columnar shape, a prismatic columnar shape, or a like columnar shape.

The center electrode 5 assumes the form of a rod having an approximately cylindrical columnar shape. However, in the present invention, the center electrode may assume the form of a rod having an approximately elliptical columnar shape, or a prismatic columnar shape, such as a square columnar shape.

EXAMPLES

Example 1 and Comparative Example 1

A double-layer square rod having the inner layer 32 (copper alloy) and the outer layer 33 (nickel alloy) was fabricated by use of a copper alloy and a nickel alloy in accordance with the above-described method. The square rod has a cross-sectional dimension of 1.3×2.7 (mm). In this manner, the intermediate of the main ground electrode and the intermediates of the auxiliary ground electrodes were fabricated. Subsequently, the cylindrical columnar inner layer 5A (copper) and the cup-shaped outer layer 5B (nickel alloy) were fabricated, and the center electrode 5 was fabricated in accordance with the above-described method. Subsequently, the noble metal tip 34 and the center-electrode noble metal tip 5C were fabricated in the above-described manner, and the noble metal tip 34 was resistance-welded to the distal end portion end surface of the intermediate of the main ground electrode, and the center-electrode noble metal tip 5C was welded to the front end portion end surface of the center electrode 5.

Subsequently, the metallic shell 3 was fabricated by use of low carbon steel, and the respective proximal end portions of the intermediate of the main ground electrode and the intermediates of the three auxiliary ground electrodes were joined, through welding, to the front end surface 3A of the metallic shell 3 at equal intervals as shown in FIG. 2(*a*). Subsequently, the center electrode 5 was assembled to the insulator 2 fabricated from a material powder containing alumina as the main component in accordance with the above-described method, and the insulator 2 was assembled to the metallic shell 3. Subsequently, the respective distal end portions of the intermediate of the main ground electrode and the intermediates of the three auxiliary ground electrodes were bent toward the center electrode 5, to thereby form the main spark discharge gap 38 (the average gap distance Av: 0.9 mm) and the auxiliary spark discharge gaps 42. Thus, the main ground electrode 30 and the auxiliary ground electrodes 40 were formed. In this manner, the spark plug of Example 1 according to the present invention shown in FIGS. 1 and 2 was manufactured. In this spark plug, the radius of curvature r of the center-electrode noble metal tip 5C was 0.3 mm, and the above-mentioned ratio "S/Av" was 0.65.

Figure 9:
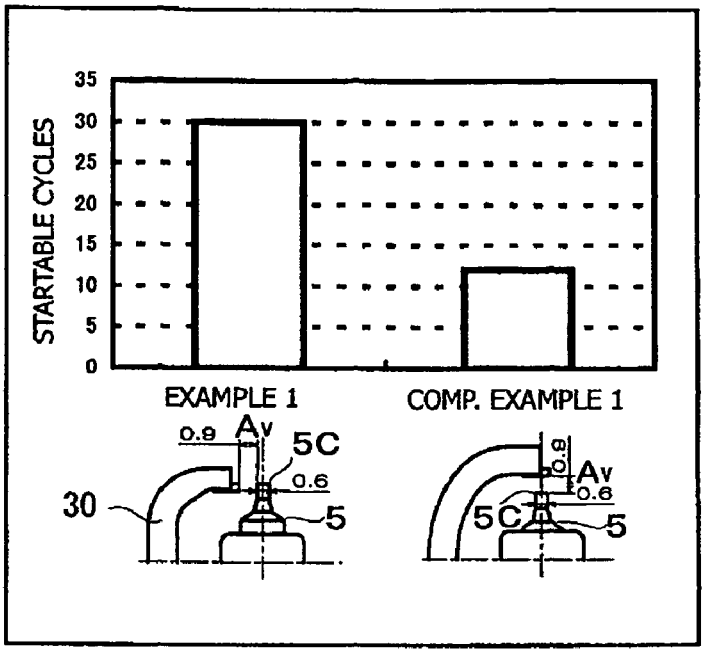
FIG. 9 is a graph showing results of a cold startability test performed for Example 1 and Comparative Example 1.

Meanwhile, as shown in FIG. 9, a so-called "parallel-type" spark plug of Comparative Example 1 in which the noble metal tip of the main ground electrode was disposed on the front end side of the center electrode with respect to the direction of the axis was manufactured basically in the same manner as in the case of the spark plug of Example 1. In the spark plug of Comparative Example 1, the average gap distance Av of the main spark discharge gap between the noble metal tip and the center-electrode noble metal tip 5C was set to 0.9 mm, the outer diameter of the center-electrode noble metal tip 5C was set to 0.6 mm, and the ratio "S/Av" was adjusted to 0.63.

Cold Startability Test

The spark plugs of Example 1 and Comparative Example 1 manufactured in the above-described manner were attached to a four-cylinder gasoline engine (displacement: 1600 cc), and a cold startability test was carried out by operating the engine, while using lead-free regular gasoline and engine oil of 5W-30, under the conditions that room temperature was −30° C., oil temperature was −25° C. or lower, and water temperature was −30° C. Specifically, the engine key was turned to an engine start position, and was returned to the original position when the engine started after 15 seconds had elapsed or within the 15 second period. This start operation through operation of the engine key was repeated 30 times (30 cycles). In the case where the engine did not start until 15 seconds elapsed after the engine key had been turned to the engine start position, the test was interrupted. The number of cycles in which the engine started continuously within the 15 second period was counted. FIG. 9 shows the results of the cold startability test. As shown in FIG. 9, the spark plug of Comparative Example 1 was able to start the engine only a small number of times. In contrast, the spark plug of Example 1 according to the present invention was able to continuously start the engine 30 times (in 30 successive cycles).

Example 2 and Comparative Example 2

Figure 10:
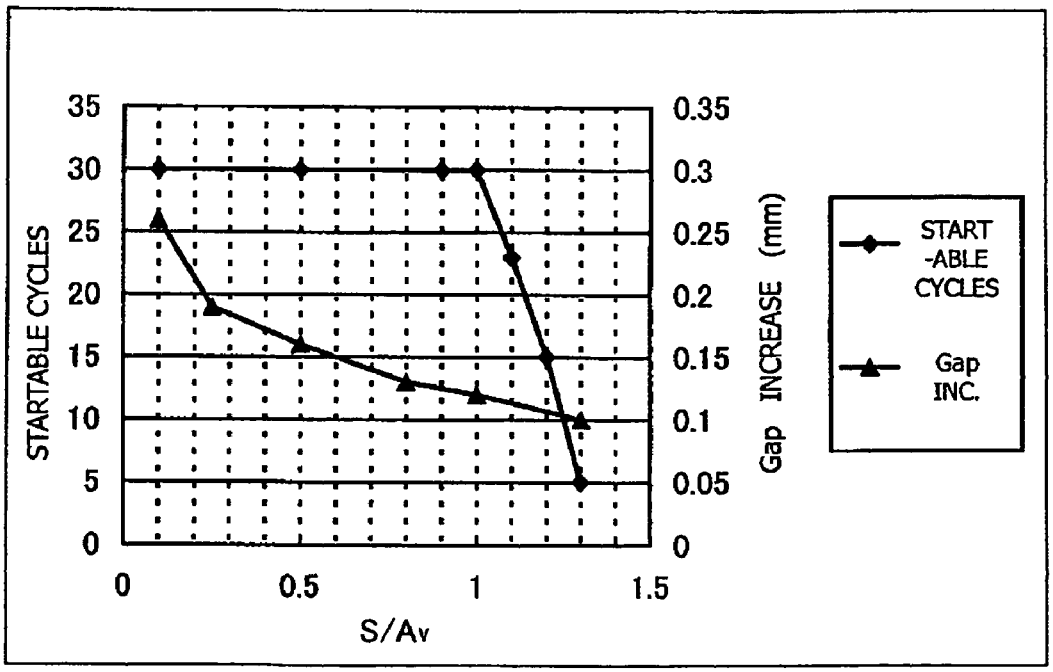
FIG. 10 is a graph showing results of a cold startability test and an on-bench spark durability test performed for Example 2 and Comparative Example 2.

Spark plugs of Example 2 and Comparative Example 2 were manufactured in the same manner as in the case of Example 1. Notably, the ratio "S/Av" (the ratio between the total area S ($mm^2$) and the average gap distance Av (mm)) was adjusted within a range of 0.1 to 1.3 by changing the amount of overlapping between the noble metal tip 34 and the center-electrode noble metal tip 5C in the direction of the axis. FIG. 10 shows the results of a cold startability test performed for the spark plugs of Example 2 and Comparative Example 2 in the same manner as in the case of Example 1. As shown in FIG. 10, the spark plugs of Example 2 in which the ratio "S/Av" was less than 1.3 were able to continuously start the engine a relatively large number of times. In particular, the spark plugs of Example 2 in which the ratio "S/Av" was equal to or less than 1 were able to continuously start the engine 30 times (in 30 successive cycles). In contrast, the spark plug of Comparative Example 2 in which the ratio "S/Av" was 1.3 was able to continuously start the engine only 5 times.

On-Bench Spark Durability Test

An on-bench spark durability test was also performed by use of the spark plugs of Example 2 and Comparative Example 2. That is, under a pressure of 0.4 MPa, a high voltage (frequency: 100 Hz) was continuously applied to each of the spark plugs for 250 hours in order to generate spark discharge at the main spark discharge gap 38 between the noble metal tip 34 of the main ground electrode 30 and the center-electrode noble metal tip 5C of the center electrode 5. After that, the consumption amount of the noble metal tip 34 was measured by use of a laser profile measuring device. The consumption amount of the noble metal tip 34 (also referred to as the "Gap increase") is an index used for evaluating the amount of consumption of an electrode caused by spark discharge in an actual spark plug. The smaller the amount of consumption, the higher the spark abrasion resistance. FIG. 10 shows the results of the on-bench spark durability test. As shown in FIG. 10, when the spark abrasion resistance associated with the main spark discharge gap 38 is important, the ratio "S/Av" is desirably set to 0.25 or greater.

Example 3

Figure 11:
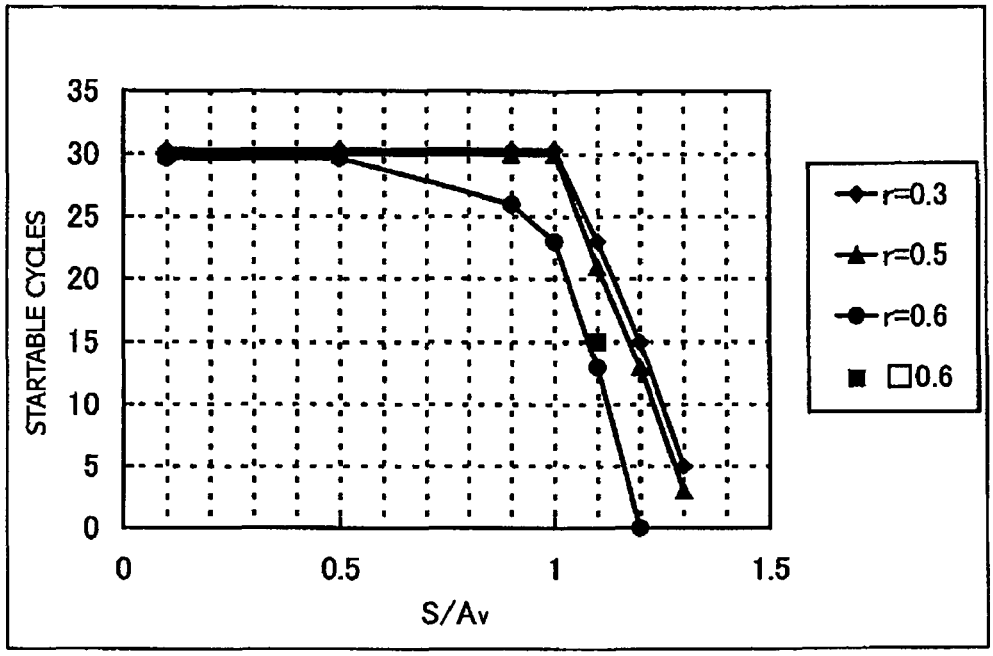
FIG. 11 is a graph showing results of a cold startability test performed for Example 3 and Example 4.

Spark plugs of Example 3 were manufactured in the same manner as in the case of Example 1, except that the radius of curvature r of the center-electrode noble metal tip 5C was set to 0.3 mm, 0.5 mm, and 0.6 mm. FIG. 11 shows the results of a cold startability test performed for the spark plugs of Example 3 in the same manner as in the case of Example 1. As shown in FIG. 11, in the case where the radius of curvature r of the center-electrode noble metal tip 5C was equal to or less than 0.5 mm, irrespective of the ratio "S/Av," the number of cycles in which the engine was able to be started continuously was relatively large. In particular, in the case where the ratio "S/Av" is equal to or less than 1, irrespective of the radius of curvature r, the engine was able to be started continuously 30 times (in 30 successive cycles). In contrast, in the case where the radius of curvature r of the center-electrode noble metal tip 5C was 0.6 mm, the number of cycles in which the engine was able to be started continuously decreases in a range in which the ratio "S/Av" was about 1 or greater.

Example 4

A spark plug of Example 4 was manufactured in the same manner as in the case of Example 1, except that a square-rod-like center-electrode noble metal tip 5C having a square bottom surface (0.6 mm×0.6 mm) was joined to the front end portion of the center electrode 5 so that its side surface faces the noble metal tip 34 in parallel thereto. This spark plug is basically the same as a spark plug in which the radius of curvature r of the center-electrode noble metal tip is set to 0.3 mm, except that, as viewed on a plane radially extending from the axis of the center electrode 5, the distance between the distal end portion end edge 34C of the noble metal tip 34 and the side surface of the center electrode 5, as measured along an imaginary line connecting the axis of the center electrode 5 and the axis of the main ground electrode 30, is maintained constant along a direction perpendicular to the imaginary line. The results of a cold startability test which was performed for the spark plug of Example 4 in the same manner as in the case of Example 1 are indicated by a solid square mark in FIG. 11. As shown in FIG. 11, the spark plug of Example 4 was able to continuously start the engine a relatively large number of times, which was, however, fewer as compared with the spark plugs in which the distance along the imaginary line varied along the direction perpendicular to the imaginary line; in particular, the spark plugs in which the radius of curvature r was 0.3 mm.

Example 5

Spark plugs of Example 5 in which the shortest distance F was set to 0.5, 1, 1.5, 2, 2.5, 3, and 3.5 (mm) were manufactured in the same manner as in the case of Example 1, except that the axial length of the insulator 2 was changed so as to change the position of the front end surface of the insulator 2 in relation to the noble metal tip 34 of the main ground electrode 30. Basically, each of the spark plugs of Example 5 has the same configuration as the spark plug of Example 1 except for the shortest distance F, and has one main ground electrode 30 and three auxiliary ground electrodes 40. Notably, as described above, the shortest distance F is the maximum distance between the above-described center point "a" of the main spark discharge gap 38 and the above-described intersections b1 and b2. A fouling resistance test and an igniting performance test were performed by use of the spark plugs of Example 5.

Fouling Resistance Test

Figure 12:
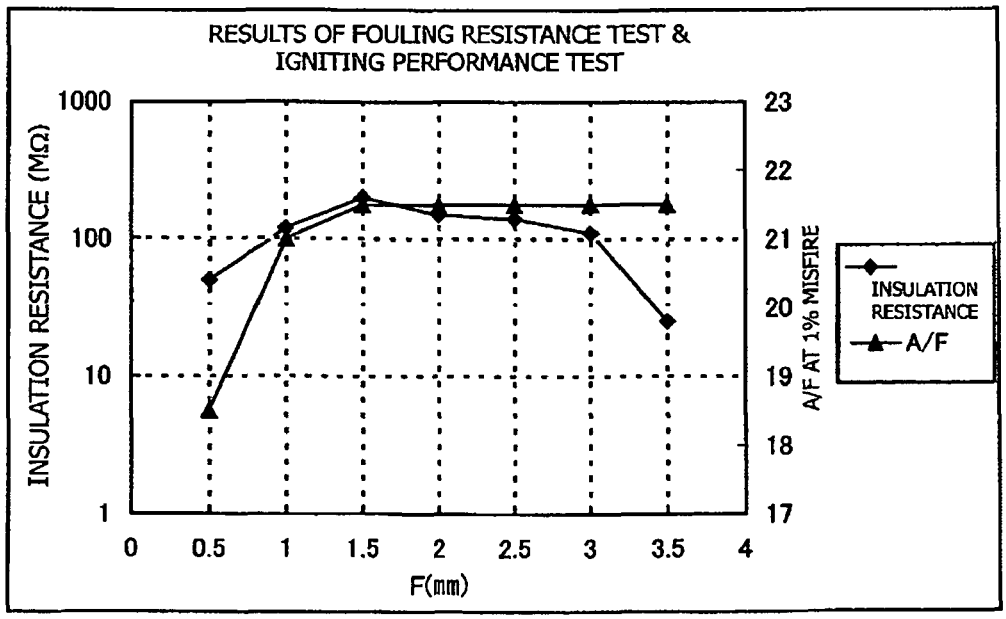
FIG. 12 is a graph showing results of a fouling resistance test and an igniting performance test performed for Example 5.

Each of the spark plugs was attached to a four-cylinder, direct-injection-type gasoline engine (displacement: 1800 cc) whose water temperature was set to −20° C., and a pre-delivery fouling test prescribed in JIS D1606 was performed in a test room (room temperature: −20° C.) Specifically, the engine was started, raced several times, and operated at 35 km/h (third speed) for 40 seconds. Subsequently, the engine was idled for 90 seconds, again operated at 35 km/h (third speed) for 40 seconds, and then stopped. After that, the engine was cooled completely until the temperature of the cooling water became equal to the room temperature. Then, the engine was again started and raced, was caused to repeat two times operation at 15 km/h (first speed) for 15 seconds and stoppage for 30 seconds, was again operated at 15 km/h (first speed) for 15 seconds, and was stopped. After this series of test patterns, constituting one cycle, were repeated 10 times (10 cycles), each spark plug was removed from the engine, and the insulation resistance between the metallic shell 3 and the connection terminal of each spark plug was measured. In this test, lead-free regular gasoline and engine oil of 5W-30 were used. FIG. 12 shows results of this test. The greater the insulation resistance (MΩ) measured in the fouling resistance test, the higher the fouling resistance (sooting-up prevention performance).

Igniting Performance Test

Each of the spark plugs (in which the auxiliary ground electrodes 40 were not provided) was attached to a six-cylinder gasoline engine (displacement: 200.0 cc) capable of changing the air-fuel ratio (A/F), and the engine was operated at 2000 rpm (intake pressure: −350 mmHg). An air-fuel ratio (A/F) at which the misfire rate became 1% (referred to as "A/F at 1% misfire rate") was recorded as an ignition limit. Specifically, the A/F at 1% misfire rate was determined as follows. At each adjusted air-fuel ratio, when the combustion chamber pressure became 50% or less of the average value of the indicated means effective pressure (IMEP) of 1000 cycles, misfire was determined to have occurred. An air-fuel ratio at which misfire occurred 10 times was recorded as the A/F at 1% misfire rate. FIG. 12 shows the results of this test. The greater the value of A/F at 1% misfire rate determined in the igniting performance test, the higher the igniting performance.

As shown in FIG. 12, the spark plugs of Example 5 were excellent in terms of fouling resistance (sooting-up prevention performance) and igniting performance. In particular, in the case of the spark plugs of Example 5 whose shortest distance F fallen within a range of 1 to 3 (mm), the insulation resistance was 100 MΩ or higher, and the A/F at 1% misfire rate was 20 or higher. Therefore, these spark plugs had more excellent fouling resistance (sooting-up prevention performance) and igniting performance.

The invention claimed is:

1. A spark plug comprising:

a rod-like center electrode extending in a direction of an axis;

an approximately cylindrical tubular insulator provided on the periphery of the center electrode;

a tubular metallic shell provided on the periphery of the insulator; and a main ground electrode and at least two auxiliary ground electrodes having respective proximal end portions joined to a front end portion of the metallic shell, the spark plug being characterized in that the main ground electrode is disposed so that its distal end portion faces a side surface of a front end portion of the center electrode and forms a main spark discharge gap between the distal end portion and the front end portion of the center electrode;

each of the auxiliary ground electrodes is disposed so that a portion of its distal end portion end surface faces an outer circumferential surface of a front end portion of the insulator; and a total area S ($mm^2$) satisfies an expression $S/Av<1.3$, which represents a relation between the total area S and an average gap distance Av (mm) of the main spark discharge gap, where the total area S is the sum of a projection area C ($mm^2$) of a portion of the distal end portion of the main ground electrode which overlaps with a projected region of the front end portion of the center electrode when the distal end portion of the main ground electrode and the front end portion of the center electrode are projected along a radial direction of the center electrode, and a projection area D ($mm^2$) of a portion of the front end portion of the center electrode which overlaps with a projected region of the distal end portion of the main ground electrode when the distal end portion of the main ground electrode and the front end portion of the center electrode are projected along the radial direction of the center electrode.

2. A spark plug according to claim 1, wherein the total area S ($mm^2$) satisfies an expression $0.25 \leqq S/Av \leqq 1$, which represents a relation between the total area S and the average gap distance Av (mm).

3. A spark plug according to claim 1 or 2, wherein, as viewed on a plane radially extending from an axis of the center electrode, a distance between a distal end portion end edge of the main ground electrode and a circumferential edge of the center electrode, as measured along an imaginary line connecting the axis and an axis of the main ground electrode, varies in a direction perpendicular to the imaginary line.

4. A spark plug according to claim 1 or 2, wherein the distal end portion of the main ground electrode has an approximately flat end surface.

5. A spark plug according to claim 1 or 2, wherein the front end portion of the center electrode assumes the form of a cylindrical column having a radius of curvature of 0.5 mm or smaller.

6. A spark plug according to claim 1 or 2, wherein each of the auxiliary ground electrodes forms an auxiliary spark discharge gap between its distal end portion and the side surface of the front end portion of the center electrode so that a front end surface of the insulator is present in the auxiliary spark discharge gap; and, when gap imaginary lines of two auxiliary spark discharge gaps having the shortest distance from the main ground electrode as measured along the circumferential direction of the center electrode are depicted on a plane radially extending from the axis of the center electrode, the maximum distance F (mm) between the center point a of the main spark discharge gap and intersections b1 and b2 between the gap imaginary lines and an inner circumferential edge of the insulator is 1 to 3 mm.

* * * * *